US009976513B2

(12) United States Patent
Valencia

(10) Patent No.: US 9,976,513 B2
(45) Date of Patent: May 22, 2018

(54) PISTON WITH ENHANCED COOLING AND ENGINE ASSEMBLY EMPLOYING THE SAME

(71) Applicant: FORD GLOBAL TECHNOLOGIES, LLC, Dearborn, MI (US)

(72) Inventor: Frank Acierno Valencia, Lansing, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 207 days.

(21) Appl. No.: 15/017,724

(22) Filed: Feb. 8, 2016

(65) Prior Publication Data

US 2016/0273485 A1 Sep. 22, 2016

(30) Foreign Application Priority Data

Mar. 16, 2015 (CN) ..... 2015 1 0114620

(51) Int. Cl.

| | |
|---|---|
| ***F02F 3/22*** | (2006.01) |
| ***F02F 3/20*** | (2006.01) |
| ***F01P 3/08*** | (2006.01) |
| ***F02F 3/00*** | (2006.01) |
| *F02P 3/10* | (2006.01) |

(52) U.S. Cl.

CPC ..... *F02F 3/20* (2013.01); *F01P 3/08* (2013.01); *F02F 3/0076* (2013.01); *F02F 3/22* (2013.01); *F02P 3/10* (2013.01)

(58) Field of Classification Search

CPC ..... F02F 3/22; F01P 3/08; F01P 3/10

See application file for complete search history.

(56) References Cited

U.S. PATENT DOCUMENTS

| | | | | |
|---|---|---|---|---|
| 4,142,484 | A * | 3/1979 | Buhl | F01M 1/06 123/193.6 |
| 5,860,395 | A | 1/1999 | Klotz et al. | |
| 2011/0192359 | A1* | 8/2011 | Kim | F02F 3/22 123/41.35 |
| 2013/0098316 | A1* | 4/2013 | Stan | F02F 3/003 123/41.35 |
| 2013/0139767 | A1 | 6/2013 | Koyama et al. | |

FOREIGN PATENT DOCUMENTS

| | | |
|---|---|---|
| CN | 202578872 U | 12/2012 |
| DE | 4112889 A1 | 10/1991 |
| EP | 1653060 A1 | 5/2006 |

OTHER PUBLICATIONS www.motoiq.com, "Skyactive", Dec. 19, 2014, 1 page.
www.i118.photobucket.com, "RB25DET" and "RB26DETT", Dec. 19, 2014, 1 page.

* cited by examiner

*Primary Examiner* — Jacob Amick
*Assistant Examiner* — Charles Brauch
(74) *Attorney, Agent, or Firm* — Brooks Kushman P.C.; Julia Voutyras

(57) ABSTRACT

A piston of an internal combustion engine is provided and includes a piston skirt enclosing at least a portion of an underside of a piston crown. A cooling oil passageway is provided on the underside of the piston and extends from a first part to a second part of the underside, where the first part is closer than the second part to a fluid flow from a cooling oil source. The cooling oil passageway may include a main channel and a branch channel extending from the main channel at an angle.

15 Claims, 5 Drawing Sheets

PISTON WITH ENHANCED COOLING AND ENGINE ASSEMBLY EMPLOYING THE SAME

CROSS-REFERENCE TO RELATED APPLICATIONS

This application claims foreign priority benefits under 35 U.S.C. § 119(a)-(d) to CN 2015 10 11 46 20.2 filed Mar. 16, 2015, which is hereby incorporated by reference in its entirety.

TECHNICAL FIELD

One or more embodiments relates to a piston with enhanced cooling and an engine assembly employing the same.

BACKGROUND

Internal combustion engines each traditionally include a piston that reciprocates inside a cylinder. The piston, which transmits pressure inside the cylinder to a crankshaft through a connecting rod, is often exposed to high-temperature combustion gas as well as high combustion pressure and therefore may experience fatigue failure or frictional wear due to thermal deformation which in turn may cause damage to the piston.

Certain existing internal combustion engines use inject cooling oil with an attempt to provide cooling to the engine and the piston in particular. Publication US2013/0139767 discloses the use of a cooling oil inject along with oil rings positioned on a side wall of the piston for the purported improvement in oil distribution.

SUMMARY

In various embodiments, an engine and a piston of an internal combustion engine is provided, which includes a piston skirt enclosing at least a portion of an underside of a piston crown, and a cooling oil guide or passageway positioned on and extending from a first part to a second part of the underside, the first part being closer than the second part to a cooling oil source. The cooling oil passageway may include a main channel and a branch channel extending from the main channel at an angle. The angle may be greater than zero and smaller than 90 degrees.

The cooling oil passageway may be defined by a recess of the underside of the piston crown. The cooling oil passageway may be defined by a protrusion extending from the underside of the piston crown.

The piston may further include a pair of pin bores to receive there-through a piston pin, at least one of the pair of pin bores being positioned between the first and second parts of the piston crown underside.

The cooling oil passageway may be made of a material that is different than a material used to form the piston crown.

The main channel and the branch channel of the cooling oil passageway may contact the second part of the underside of the piston crown. The second part of the piston underside may have more branch channels than the first part of the underside. The branch channel may extend from the piston crown underside toward an upper-side of the piston crown.

One or more advantageous features as described herein will be readily apparent from the following detailed description of one or more embodiments when taken in connection with the accompanying drawings.

BRIEF DESCRIPTION OF THE DRAWINGS

For a more complete understanding of one or more embodiments of the present disclosure, reference is now made to the one or more embodiments illustrated in greater detail in the accompanying drawings and described below wherein.

DETAILED DESCRIPTION

Figure 1:
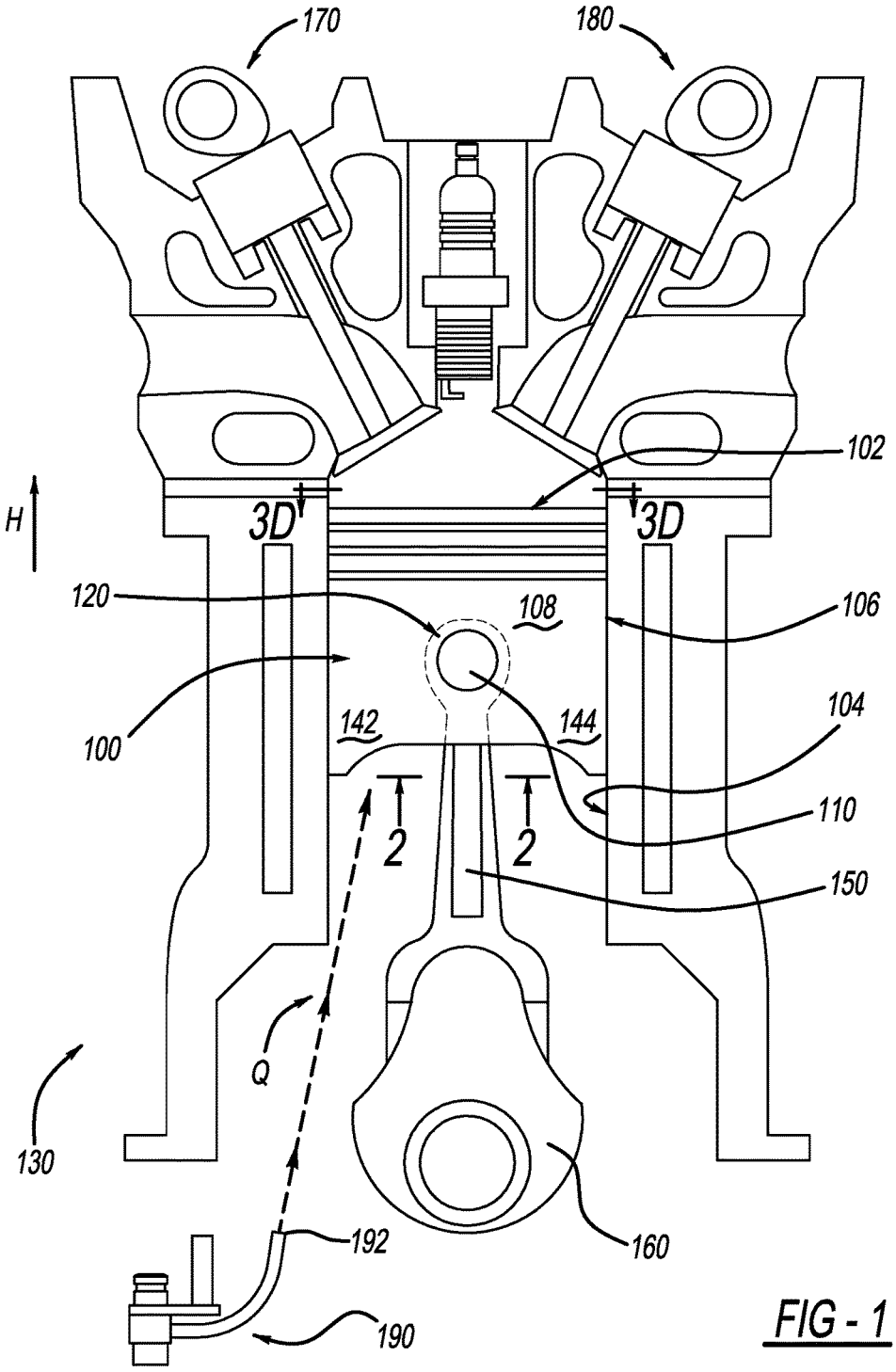
FIG. 1 illustratively depicts a piston positioned relative to a cylinder of an engine assembly according to one or more embodiments.

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

As referenced in the Figures, the same reference numerals are used to refer to the same or similar components. In the following description, various operating parameters and components are described for different constructed embodiments. These specific parameters and components are included as examples and are not meant to be limiting. The drawings referenced herein are schematic and associated views thereof are not necessarily drawn to scale.

One or more embodiments described herein provide a piston with enhanced cooling and an engine assembly employing the same. With the enhanced cooling, the piston and the engine assembly may have an increased or relatively higher resistance to thermal fatigue and hence a prolonged operational life span.

As described herein, the piston and associated engine assembly are configured such that a fluid, such as a cooling lubricant or cooling oil, may reach relatively farther-away or remote locations to cover relatively more areas or a larger area on an underside of the piston. The cooling passages on the underside of the piston may be further enhanced by the addition of branches that extend to or contact additional regions or areas of the underside of the piston experiencing thermal stress. Accordingly, the piston and the associated engine assembly are provided with an increased and/or relatively more uniform cooling oil distribution resulting in enhanced cooling. Furthermore, the piston and the associated engine assembly may require relatively less maintenance and hence less economic expenditure.

Figure 2:
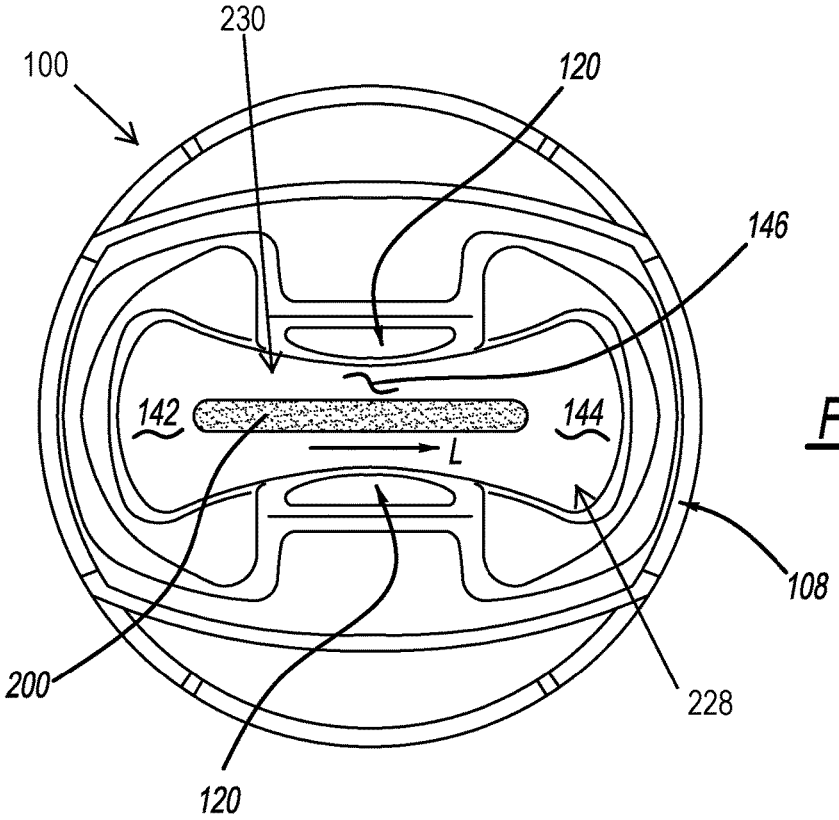
FIG. 2 illustratively depicts a bottom view of the piston referenced in FIG. 1.

In one or more embodiments, and as illustratively depicted in FIGS. 1 and 2, a piston 100 of an internal combustion engine 130 includes a piston skirt 108 encircling or enclosing at least a portion of an underside 228 of a piston crown 102, and a cooling oil passageway 200 or guide 200 formed on the underside 228 to extend from a first part 142 to a second part 144 of the underside 228. The crown 102 is opposed to the underside 228, and the skirt 108 extends about a perimeter of the underside 228 or encircles the underside. The first part 142 is positioned to be closer than the second part 144 to a cooling oil source 190. The first and second parts 142, 144 may each refer to areas or regions of the underside 228 positioned outside of, external to, or apart from the pin bore 120. Alternatively, the first and second parts 142, 144 may refer to two end portions or regions sandwiching a central part 146 of the underside 228, where the central part 146 is positioned between the pair opposed openings to the pin bore 120.

Referring to FIG. 1, the piston 100 is depicted as being defined inside of a cylinder wall 104 forming a cylinder in a cylinder block of an engine assembly 130. The engine assembly 130 may further include an inlet valve camshaft 180 and an exhaust valve camshaft 170 to provide fluid communication between the inlet and exhaust ports with the piston 100 and cylinder 104. The piston skirt 108 forms a pin bore 120 positioned on the piston skirt 108 with a pair of openings to support a piston pin 110 therethrough. A connecting rod 150 connects a crankshaft 160 to the piston pin 110, such that the crankshaft 160 is driven by the connecting rod 150, thus transforming the reciprocating linear motion of the piston 100 into a rotational motion of the crankshaft 160. The crankshaft 160 is then connected to a vehicle drive system (not shown) through a transmission to one or more driving wheels to transmit power thereto.

A fluid source such as a lubrication or cooling oil source is provided to provide cooling and/or lubrication during engine operation, and may be provided as a cooling oil injector 190 connected to a fluid or lubricant sump for the engine. Due to the presence and position of the connecting rod 150 and the associated crankshaft 160, the placement or position of the cooling oil injector 190 relative to the cylinder 104 may be substantially limited, and often be confined to a limited route "Q" that directs fluid such as a lubricant or cooling oil to only the first part 142 of the underside 228 and not directly to the second part 144.

Without being limited to any particular theory, the cooling oil or fluid passageway 200 as described herein provides for enhanced cooling oil transport and distribution on and about the underside 228 of the piston 100, with a particular enhancement of cooling oil and fluid distribution from the first part 142 toward the second part 144 of the underside 228 of the piston. Accordingly, via the use of the cooling oil passageway 200, the piston 100 and hence the cylinder 104 and engine 130 are believed to be provided with relatively reduced thermal stress or operational damage.

The cooling oil injector 190 may be of any form, material and/or construction to direct a fluid such as a lubricant or cooling oil to the underside 228 of the piston 100. In particular, the injector 190 may include or be in the form of a nozzle 192.

Referring to FIG. 2, the cooling oil passageway 200 extends from the first part 142 toward the second part 144 of the underside 228, and accordingly extends in a longitudinal direction "L" such that the passage 200 has a first end region associated with the first part 142, and a second opposed end region associated with the second part 144. The passageway 200 may be of any suitable length along the longitudinal direction "L" and in certain embodiments be of a length that spans up to an entire width or diameter of the piston underside 228 along the longitudinal direction "L" and may further contact the second part 144 of the underside 228. The passage 200 may also have varying widths, and may have a width in a direction perpendicular to the direction "L" up to a length of the pin bore 120.

Referring to FIG. 2, the underside 228 may include an elongated flat or substantially flat area 230, defining the first and second parts 142, 144 positioned on either side of the central part 146 or region. Without the cooling oil passageway 200, the underside 228 in its basic elongated flat appearance may not efficiently conduct or direct the fluid or cooling oil across the underside 228 and the overall cooling effect may be low or less than desirable. The cooling oil passageway 200 provides for more effective control of the flow of the cooling oil as well as control over the direction of the flow, for example, with reduced random dripping away of the cooling oil from the underside 228 and hence unnecessary waste or inefficiencies in cooling oil.

The cooling oil passageway 200 may at least partially be configured in the form of a groove on the underside 228, which may be created via material removal from the underside 228 via cutting, knifing, punching or suitable machining. Alternatively the cooling oil passageway 200 may at least partially be configured as one or more channels having at least one wall extending outwardly from the underside 228, where the underside 228 forms the floor of the one or more channels or a separate floor is provided separately from the underside 228 as the floor. In the configuration where the cooling oil passageway 200 includes channels or walls protruding from the underside 228, the cooling oil passageway 200 in part or in whole may be pre-formed and subsequently attached onto the underside 228 via any suitable methods including welding, adhesion, brazing, etc. The cooling oil passageway 200 may differ from the underside 228 in material and may be pre-formed with any suitable methods. By way of example, the cooling oil passageway 200 may include or be formed of a metal, a metal alloy, and/or a high-strength refractory material. In other examples, the cooling oil passageway 200 may be formed or partially formed during a formation process for the piston, for example, via molding, casting, etc.

The cooling oil passageway 200 may be of any suitable length along the "L" direction. In certain embodiments, the cooling oil passageway 200 may be of a length ranging from 0.1 centimeters (cm) to 10 cm, 0.25 cm to 7.5 cm, or 0.5 cm to 5 cm.

The cooling oil passageway 200 may be of any suitable depth. In certain embodiments, the cooling oil passageway 200 may be of a depth ranging from 0.1 millimeters (mm) to 10 mm, 0.25 mm to 7.5 mm, or 0.5 m to 5 mm. The cooling oil passageway 200 may have a constant depth or may have a varying or graduated depth to control the fluid flow.

The cooling oil passageway 200 does not necessarily have to be linear or straight along the longitudinal direction "L" and may adopt various other suitable shapes instead. The cooling oil passageway 200 may extend to be adjacent to the piston skirt 108, and may even extend onto an inner surface or wall of the piston skirt 108.

Figure 3A:
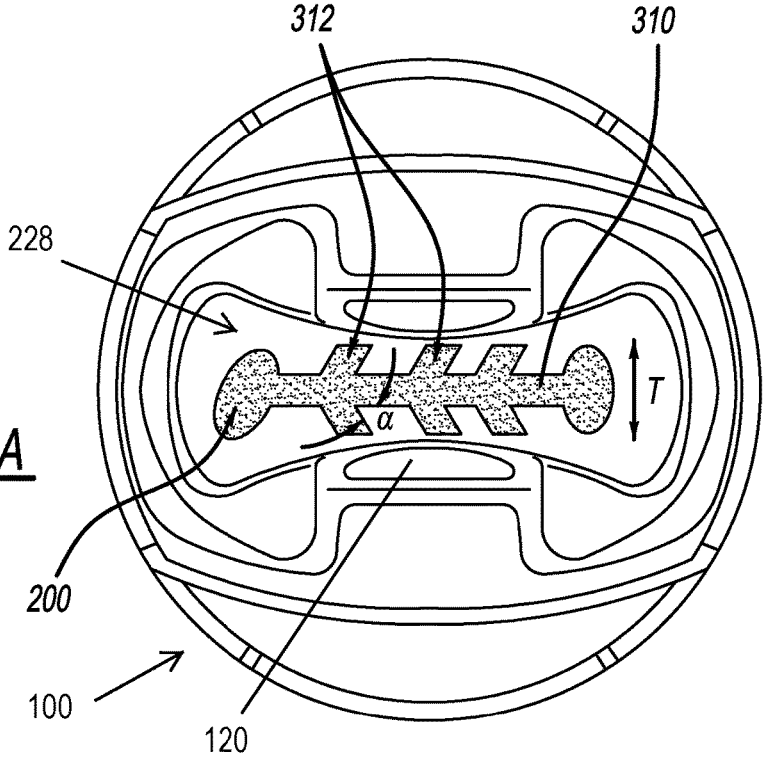
FIG. 3A illustratively depicts an alternative bottom view of the piston referenced in FIG. 2.

In one or more embodiments, and as shown in FIG. 3A, the cooling oil passageway 200 includes a main channel 310 and a branch channel 312 extending from the main channel 310 at an angle $\alpha$. The cooling oil passageway 200 as shown in FIG. 3A provides directed and controlled fluid flow and cooling to areas of the underside 228 along a transverse direction "T" that is transverse to or at an angle relative to the longitudinal direction "L."

The angle α may be oriented in favor of the flow of the cooling oil. In various embodiments, the angle α ranges from 0 up to and including 90 degrees, between 15 to 75 degrees, or 30 to 50 degrees.

Referring to FIG. 3A, more than one branch channel 312 may be positioned along one or both sides of the main channel 310 to facilitate the distribution and flow of the cooling oil. When more than one branch channels 312 are present, each of the branch channels 312 may be positioned relative to the main channel 310 at a different angle, or at the same angle relative to the main channel 310. Specific dimensions of each of the main channel 310 and the one or more branch channels 312, including the length, the width, the depth and the general contour and shape, do not necessarily have to be limited to those illustratively depicted in the Figures and may be of any suitable values as long as they facilitate the flow and distribution of the cooling oil from the cooling oil source 190. For example, the angle, length, width and/or depth of the branch channels 312 may vary along the longitudinal direction "L", or downstream with respect to the cooling oil flow to provide a controlled flow rate or flow direction of the cooling oil in the passage 200 and to the various locations of the underside 228 of the piston 200.

Figure 3B:
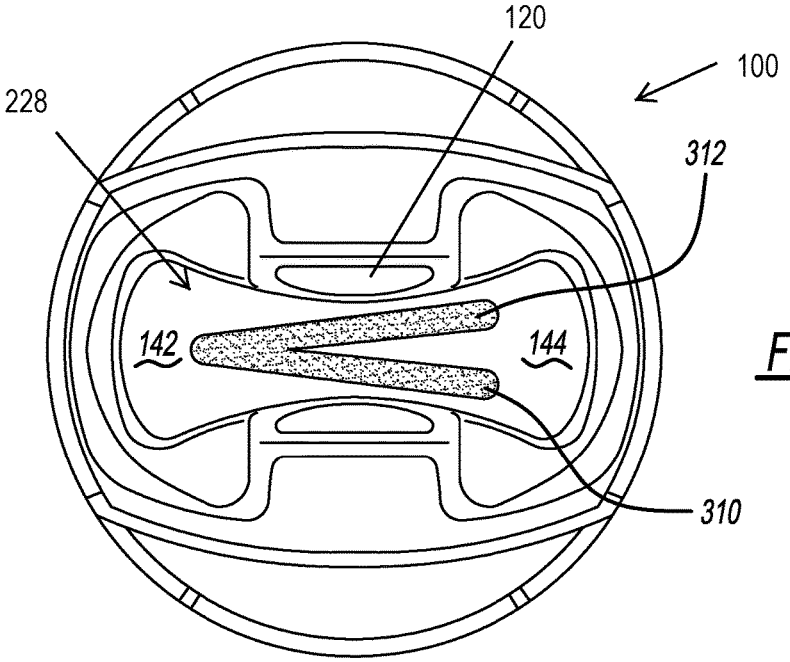
FIG. 3B illustratively depicts an alternative bottom view of the piston referenced in FIG. 2.

Alternatively, and as shown in FIG. 3B, the cooling oil passageway 200 includes a main channel 310 and a branch channel 312 together forming a generally "V" shape. The main and branch channels 310, 312 may fluidly connect to one other at a location proximal to the first part 142 of the underside 228. The cooling oil passageway 200 as shown in FIG. 3B provides cooling to areas of the underside 228 with a particular focus on the second part 144 thereof, as the channels 310, 312 are spaced apart in the second part 144 of the underside 228. One or both of the main and branch channels 310, 312 may be formed with a dimension, including a width, a length and/or a depth, that rapidly and directly leads the flow of the cooling oil to the second part 144 where cooling may be needed during engine operation based on its remote location compared to the flow of cooling oil to the underside 228 of the piston 100, as the cooling oil only directs impinges on the first part 142 and is provided only indirectly to the second part 144, e.g. via the passage 200. One or both of the main and branch channels 310, 312 as depicted in FIG. 3B may be configured to deliver fluid flow via capillary effects so as to further the benefit of rapidly and directly leading the cooling oil flow.

Figure 3C:
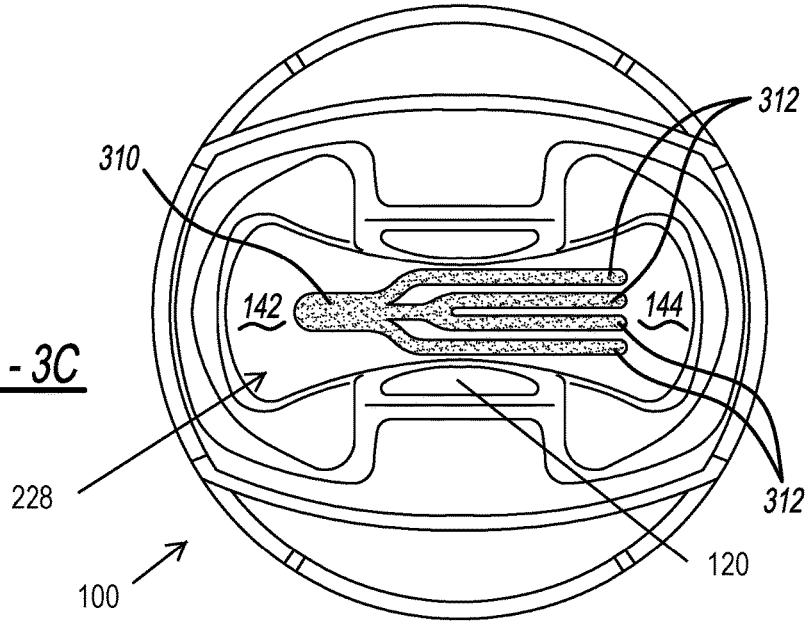
FIG. 3C illustratively depicts an alternative bottom view of the piston referenced in FIG. 2.

In one or more embodiments, and as shown in FIG. 3C, the cooling oil passageway 200 includes a main channel 310 and a plurality of branch channels 312 extending from the main channel 310, where the branch channels 312 are positioned generally parallel to and spaced apart from one another, or side-by-side next to one another with a space in between any two adjacent branch channels 312. Accordingly, there are more spaced apart branch channels 312 within the second part 144 in comparison to main channel 310 in the first part 142, and the channels 312 in the second part 144 extend over a larger area than the channel 310 in the first part 142.

Figure 3D:
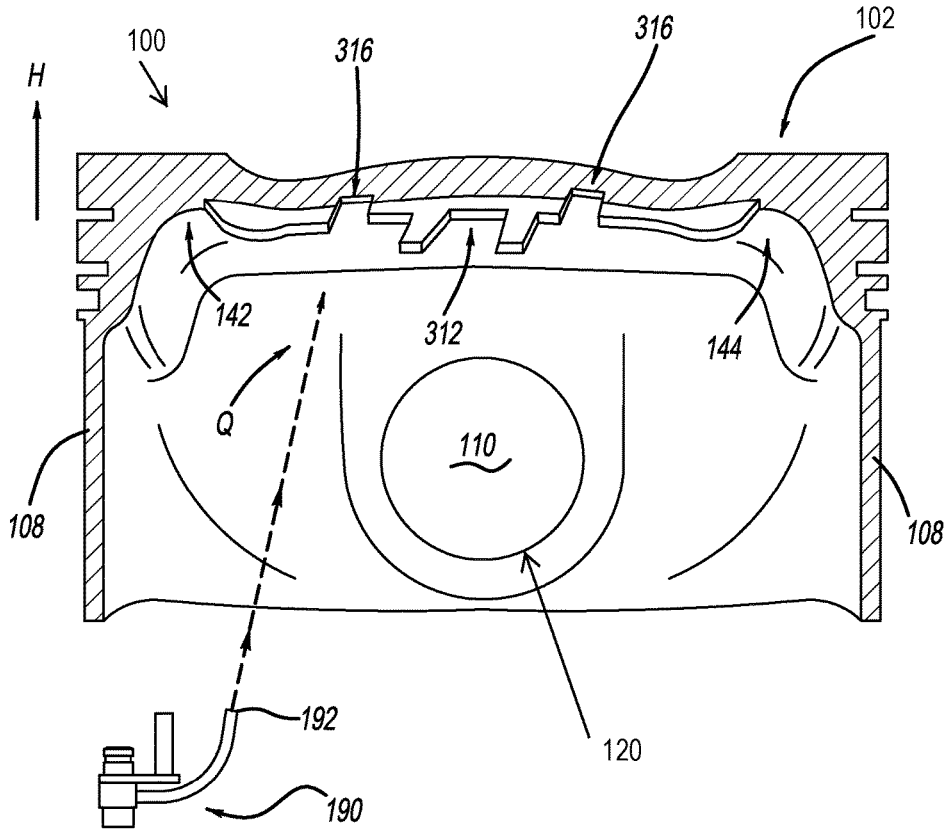
FIG. 3D illustratively depicts a cross-sectional view of the piston referenced in FIG. 2.

FIG. 3D illustrates a cross-sectional view of the piston 100 referenced in FIG. 2, wherein the cooling oil passageway 200 includes one or more branch channels 312 extending along the underside 228 and one or more branch channels 316 extending from the underside 228 toward the upper side or crown 102 so as to provide additional fluid flow and cooling along direction "H" in view of FIG. 1. Because the crown 102 of the piston 100 forms a part of the combustion chamber in cylinder 104, as shown in FIG. 1, the operating temperatures there are higher. Accordingly the presence of these branch channels 316 with an upward or "H" direction component helps deliver fluid flow and cooling in areas closer to the upper-side or crown 102.

Figure 4A:
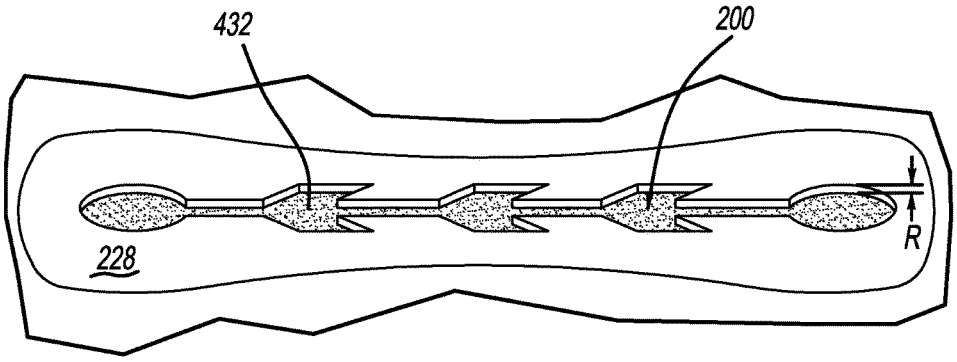
FIG. 4A illustratively depicts a cross-sectional view of the piston referenced in FIGS. 2 and 3A-3C.

As illustrated in FIG. 4A according to an example, the cooling oil passageway 200 may define or be at least partially defined as a recess or cavity on the underside 228 of the piston crown 102. When configured as a recess or cavity, the cooling oil passageway 200 includes a floor 432 spaced apart from or offset from the underside 228 by a distance "R" such that the floor 432 is closer to the crown 102 than the underside 228. The recess or cavity may be created via any suitable methods with non-limiting examples including material removal of the underside 228 via machining, punching and knifing, or during a formation process for the piston 100, e.g. casting, molding, etc. Although the recess or cavity in FIG. 4A has a similar shape as the passageway as shown in FIG. 3A, the cooling oil passageway 200 according to other embodiments including those depicted in FIGS. 2, 3B and 3C may be implemented, at least partially defined or defined similarly as the recess or cavity depicted in FIG. 4A. A benefit of the cavity or recess is that fluid flow and associated cooling may be provided at locations of the piston 100 in a direction toward an upper-side or crown 102 and within the piston 100 and not only along the underside 228.

Figure 4B:
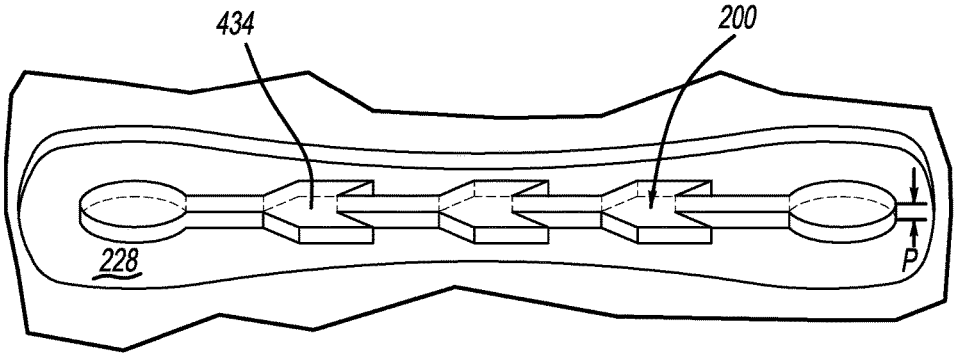
FIG. 4B illustratively depicts an alternative cross-sectional view of the piston referenced in FIGS. 2 and 3A-3C.

As illustrated in FIG. 4B according to an example, the cooling oil passageway 200 may define or be at least partially defined as a protrusion extending from the underside 228 of the piston crown 102. When configured as a protrusion, the cooling oil passageway 200 includes a surface or floor 434 spaced apart from or offset from the underside 228 by a distance "P" such that the floor 434 is farther away from the crown 102 than the underside 228, or that the underside 228 is closer to the crown 102 than the floor 434. The protrusion may be in the form of one or more pre-formed channels and the may be formed with or attached to the underside 228 via any suitable methods with non-limiting examples thereof including welding, brazing, gluing, molding, etc. Although the protrusion shown in FIG. 4B has a similar shape to as the passageway shown in FIG. 3A, the cooling oil passageway 200 according to other embodiments including those depicted in FIGS. 2, 3B and 3C may be implemented, at least partially defined or defined similarly as the protrusion depicted in FIG. 4B. A benefit of the protrusion is that the protrusion may be replaceable and may be formed by a material that is desirable for heat transfer, e.g. has a high thermal conductivity, and is not present in the piston crown 102 or the underside 228 thereof. For example, the piston 100 may be formed from a first material, and the protrusion may be formed from a second material with different thermal characteristics.

In one or more embodiments, the disclosed piston and engine assembly as set forth herein provides enhanced and improved piston cooling.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. An engine comprising:

a piston comprising an underside opposed to and directly underneath a piston crown and encircled by a skirt, the underside defining an open channel extending longitudinally between first and second parts of the underside; and a cooling oil source providing a jet of cooling oil to the first part;

wherein the channel is shaped to direct oil of the jet from the first part to the second part.

2. The engine of claim 1, wherein the open channel is a main channel and wherein the underside further defines an open branch channel extending from the main channel at an angle thereto, the branch channel and the main channel extending along a common plane.

3. The engine of claim 2, wherein the angle formed between the main channel and the branch channel is ninety degrees or less.

4. The engine of claim 2, wherein the branch channel extends longitudinally from a first end to a second end, the first end of the branch channel intersecting the main channel, and the second end of the branch channel being positioned in the second part of the underside and spaced apart from the main channel.

5. The engine of claim 2, the piston further defines a pair of pin bores, wherein the pair of pin bores are positioned between the first and second parts of the underside of the piston, and wherein the channel extends between the pair of pin bores.

6. A piston for an engine, comprising:

a body comprising a piston crown and an underside opposed thereto, a skirt provided about a perimeter of the underside; and a cooling oil guide defined by an open channel extending longitudinally between first and second parts of the underside and through a central region of the underside positioned between a pair of pin bores to direct cooling oil flow from the first part to the second part.

7. The piston of claim 6 wherein the first part of the underside is adjacent to the skirt, and the second part of the underside is adjacent to the skirt on an opposed side of the underside.

8. The piston of claim 6, wherein the open channel of the cooling oil guide is a main channel; and wherein the guide is further defined by an open branch channel extending along the underside and extending from the main channel at an angle thereto.

9. The piston of claim 8, wherein the branch channel extends longitudinally from a first end to a second end, the first end of the branch channel intersecting the main channel, the second end of the branch channel being positioned in the second part of the underside and spaced apart from the main channel.

10. The piston of claim 8, wherein the guide is further defined by a plurality of open branch channels extending over the second part of the underside, the branch channels arranged parallel to one another.

11. The piston of claim 8 wherein the guide is further defined by a plurality of open branch channels spaced apart from one another along the main channel and between the first and second parts of the underside.

12. The piston of claim 8, wherein the angle between the main channel and the branch channel lies within a range of fifteen to seventy-five degrees.

13. The engine of claim 1 wherein the open channel extends through a central region of the underside of the piston, the central region positioned between a pair of pin bores and containing a central axis of the piston.

14. The engine of claim 4 wherein the first end of the branch channel intersects the main channel between the first and second parts of the underside.

15. The piston of claim 8 wherein the main channel and the branch channel extend in a common plane.

* * * * *